US005964151A

United States Patent [19]

Mathea

[11] Patent Number: 5,964,151

[45] Date of Patent: Oct. 12, 1999

[54] APPARATUS FOR ACCURATELY IMPRINTING CONTINUOUS FOILS

[75] Inventor: Hans Mathea, Karlsruhe, Germany

[73] Assignee: CSAT Gesellschaft für Computer Systeme und Automations-Technik mbH, Eggenstein-Leopoldshafen, Germany

[21] Appl. No.: 09/007,564

[22] Filed: Jan. 15, 1998

Related U.S. Application Data

[63] Continuation-in-part of application No. PCT/DE96/01323, Jul. 15, 1996.

[30] Foreign Application Priority Data

Jul. 15, 1995 [DE] Germany ..... 195 25 713

[51] Int. Cl.[6] ..... B41F 13/56

[52] U.S. Cl. ..... 101/227; 101/228; 101/483

[58] Field of Search ..... 101/227, 228, 101/483, 288

[56] References Cited

U.S. PATENT DOCUMENTS

| | | | |
|---|---|---|---|
| 4,531,851 | 7/1985 | Kondo et al. | 101/288 |
| 4,688,485 | 8/1987 | Tison | 101/490 |
| 4,909,426 | 3/1990 | Crowley et al. | 101/228 |
| 5,099,290 | 3/1992 | Yokota | 101/228 |
| 5,464,289 | 11/1995 | Beaudry | 101/227 |
| 5,711,225 | 1/1998 | Rasmussen | 101/483 |
| 5,765,481 | 6/1998 | Tortora et al. | 101/227 X |

*Primary Examiner*—Edgar Burr
*Assistant Examiner*—Minh H. Chau
*Attorney, Agent, or Firm*—Klaus J. Bach

[57] ABSTRACT

In an apparatus for accurately imprinting print images onto sections of a predetermined length of a continuous unmarked foil, wherein a printer is disposed at a distance from a foil section delivery device which receives from the printer unprinted foil along a predetermined path, a foil sensor is arranged along the foil path which sensor has an output connected to the printer for supplying to the printer a printing signal when the length of the foil between the delivery device and a point on the foil corresponding to the beginning of a section to be imprinted is a predetermined multiple of the length of the foil sections to be imprinted so as to initiate printing of the printer accurately within a section of the foil.

4 Claims, 1 Drawing Sheet

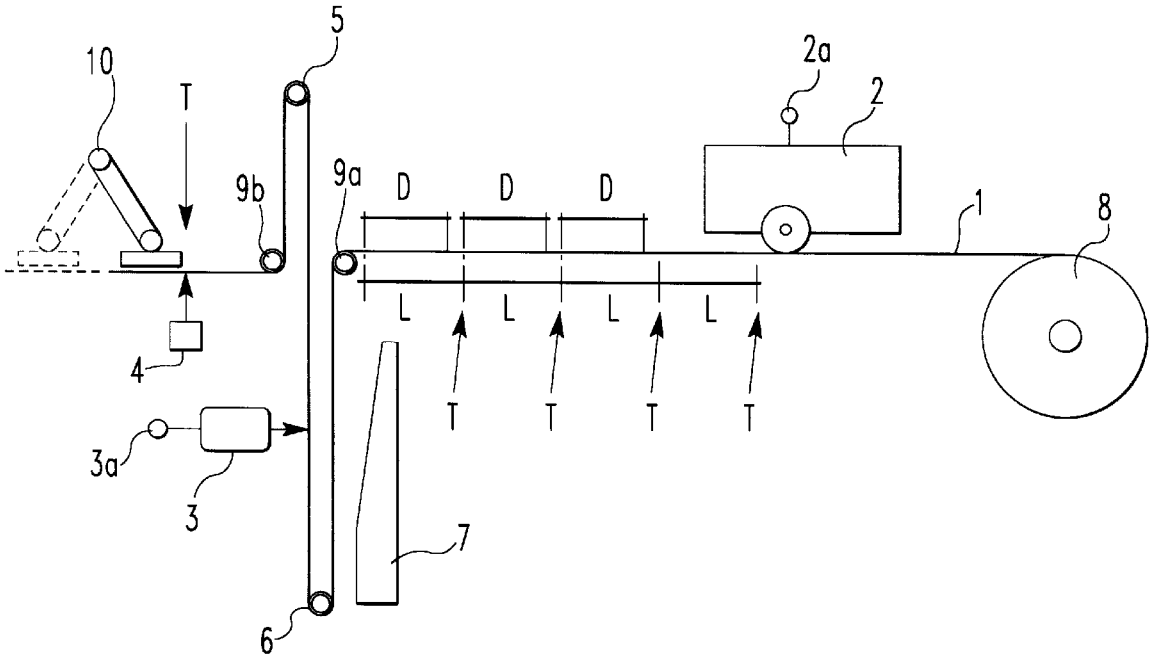
10
T
5
9b
9a
D
D
D
2a
2
1
8
L
L
L
L
T
T
T
T
4
3a
3
7
6

APPARATUS FOR ACCURATELY IMPRINTING CONTINUOUS FOILS

This is a continuation-in-part application of international application PCT/DE96/01323 filed Jul. 15, 1996 and claiming the priority of German Patent application No. 195 25 713.8 of Jul. 15, 1995.

BACKGROUND OF THE INVENTION

The invention relates to an apparatus for accurately imprinting unmarked continuous foils with images of a first predetermined length wherein, after imprinting, the foil is divided into sections of a second predetermined length. The images are imprinted on the foil such that they are accurately positioned within the foil sections.

Such printing apparatus are used for example in the pharmaceutical industry. In these applications, it is important that so-called blister packages in which for example single pills are packaged are provided with an image which is accurately imprinted onto the package at a predetermined location.

Generally, the pills are disposed in a cavity formed by a deep-drawn foil of plastic or paper which is sealed by a cover foil. Imprinted onto the cover foil is an image which generally provides some information about the pill such as information regarding the timee when the pills have to be taken. It is therefore important that the information is properly printed onto the cover foil.

Because there is a need for large amounts of such blister packagings, preprinted cover foils of a large length are utilized which are usually disposed on rolls.

Although a good printing accuracy can be achieved with modern printing techniques, it is very difficult to accurately join the cover foil with the deep drawn foil such that the imprint is properly positioned over the cavities receiving the pills since any deviations may add up in the joining process. The position of the imprinted area may therefore, in time, be substantially different from the required position.

In order to be able to join the cover foil with the deep drawn foil having the pill-receiving cavities in an accurate position, the imprint on the already imprinted foils is therefore generally somewhat smaller than it is actually necessary. The length difference provided thereby is compensated for by stretching. The cover foil is pulled by a special arrangement to assume the required length. By intentionally printing the image at a length different from the actually desired length and compensating for the difference individually by stretching the cover foil, the adding of the manufacturing tolerances can be avoided, but such a procedure is quite expensive.

DE 195 00 169 A1 discloses a printing system for the double-sided imprinting of a continuous paper web, wherein between a first and a second printer an intermediate buffer arrangement is disposed for accommodating the difference of the paper advancing speeds between the first and the second printers. A detector determines the retention volume in the intermediate buffer arrangement. A printer controller stops the printing and advancing of the first printer when the retention amount exceeds a predetermined first value. The printer controller resumes the printing and paper advance by the first printer when the retention amount falls below a second value. Printing and paper advance then continue until the retention amount exceeds again the first predetermined value.

DE 34 20 304 A1 discloses an apparatus which includes several autonomous printing units that are in a position to perform different printing processes. Furthermore, the apparatus includes one or several independent units for final treatment which are in the position to perform various finishing steps such as perforating or cutting. In addition, the apparatus includes equipment for the selective control of each of these independent units in such a way that the printing and/or finishing steps are adapted to the work performed by the high speed printer. The equipment for the selective control includes sensors which recognize markings on the carrier web to be imprinted as it is moved through the high speed printer.

It is the object of the present invention to provide a printing apparatus with which a printing image can be imprinted on a foil in an accurate position without accumulation of errors and without the need for stretching the foil.

SUMMARY OF THE INVENTION

In an apparatus for accurately imprinting print images onto sections of a predetermined length of a continuous unmarked foil, wherein a printer is disposed at a distance from a foil section delivery device which receives from the printer unprinted foil along a predetermined path, a foil sensor is arranged along the foil path which sensor has an output connected to the printer for supplying to the printer a printing signal when the length of the foil between the delivery device and a point on the foil corresponding to the beginning of a section to be imprinted is a predetermined multiple of the length of the foil sections to be imprinted so as to initiate printing of the printer accurately within a section of the foil.

In this way, the beginning of a foil section to be imprinted is predetermined with every imprint. With such constantly renewed determination of the beginning of the printing image of a section to be imprinted, any possibly occurring errors are not added up. As a result, even relatively large errors are generally harmless since the error per image or foil section is still relatively small and has no influence on the beginning of the image for the next adjacent section to be imprinted. Also, any slipping of the continuous foil does not affect the print on the foil.

If a predetermined multiple of the second predetermined length corresponds for example to ten times the length of a section to be imprinted and if the length of the foil between the cutting oe dividing device and the location on the foil where the printer would start printing if an initiation signal were present is less than ten times the second predetermined length the sensor does not provide a signal that is no imprinting process is initiated. When the additional foil is transported through the printer such that the length of the foil between the cutting device and the printer increases, soon the point is reached where the length of the foil between the cutting device and the point where the printer would start the image if an initiation signal were present corresponds to ten times the second predetermined length. At that point, the sensor supplies an output signal to the printer. That means the printer begins printing exactly at the point of the foil which corresponds to the beginning of one of the section to be imprinted.

It is particularly advantageous if as printer an electrophotographic printer such as a laser printer or an LED printer is utilized. However, the arrangement works just as well in connection with an ion transfer printer or a thermal transfer printer or another printing device. Important for the selection of the printer is only that the printer can print with accurate image positioning and the positioning can be controlled by an input signal.

In a particular embodiment of the invention which is especially advantageous if imprinted sections are removed from the apparatus in a discontinuous manner, the sensor is preferably an optical sensor, which detects the position of a compensating roller which is movably supported in such a way that the position of the compensating roller depends on the length of the foil between the cutting device and the printer. In this way, a high accuracy can be achieved.

When the foil leaves the apparatus at a speed greater than the printing speed, the length of the foil between the cutting device and the printer becomes smaller. Such a foil length reduction lasts as long as foil supplied by the printer is removed from the apparatus at speed greater than the printing speed. If foil removal stops, that is, if temporarily no foil is removed from the apparatus the process is reversed. Then the length of the foil between the cutting device and the printer increases.

To compensate for the changing length of the foil portion between the cutting device and the printer, a compensating roller is provided. The compensating roller is disposed in a loop of the foil which is generated by guiding the foil around the compensating roller. When the length of the foil becomes shorter, the compensating roller moves in the direction of the opening of the loop.

When the length of the foil increases the compensating roller moves away from the opening of the loop, whereby the path of the foil to and from the compensating roller is increased.

If the sensor is arranged at that point of the apparatus where the compensating roller is located when the path along which the foil extends between the cutting device and a location corresponding to the beginning of a section to be imprinted is for example 10 times the second predetermined length, the sensor transmits a signal to the printer. The printer then imprints an image on the desired foil location.

The accuracy can be still further improved by taking into account the length changes of the foil occurring between the printer and the foil. For this purpose, a rope may extend around the compensating roller and is firmly supported at its end adjacent the cutting device whereas it is movably supported at its end adjacent the printer. Preferably, the robe extends along the path of the foil. Since the rope is firmly mounted at one end thereof, the position of the movably arranged end of the rope depends on the position of the compensating roller. Consequently, the movable end of the rope indicates the same change in length which occurs in the foil length between the cutting device and the printer. Since the travel length of the movable end of the rope is twice that of the compensating roller the resolution of a sensor arranged at, and sensing, the movable end of the rope would be twice as good as that of a sensor associated with the compensating roller, which would be quite advantageous as far as accuracy is concerned.

For the adjustment of the compensating roller there is provided an offset roller which is so arranged that the length of the foil between the cutting device and the printer can be changed. This is advantageous when the format of the print image or the section length to be imprinted changes since this requires a change in length of the foil between the cutting device and the printer. In order to have the position of the compensating roller unchanged inspite of the change of length of the foil portion between the cutting device and the printer, the offset roller is displaced to such a degree that the length of the foil disposed between the cutting device and the printer is again a predetermined multiple of the second—that is now changed—predetermined length when the compensating roller is disposed opposite the sensor. In this way, the position of the printer does not need to be changed when the foil section length is changed.

In another advantageous embodiment of the invention, the printer speed can be controlled. It has been found to be particularly advantageous to use, in connection with a compensating roller, a proximity sensor which generates a signal dependent on the distance of the compensation roller from a ramp of the sensor. Since with the described discontinuous removal of foil from the printing apparatus the compensation roller is in constant lateral motion, preferably a mean value is formed from the sensor output signal which changes constantly because of the ramp of the proximity sensor. The offset roller is so controlled that the point about which the compensating roller moves back and forth is, with the usual section length and removal rate, about in the middle of the ramp of the sensor. Furthermore, the control is preferably so adjusted that the sensor signal value is limited up- and downwardly. This also limits the printer speed to a maximum and a minimum.

If the removal rate or the length of the imprinted sections increase, more foil is removed from the printing apparatus per time unit than before. Since the printer first continues to print at a constant speed, the length of the foil between the cutting device and the printer becomes shorter. Consequently, the point about which the compensation roller moves, changes and causes the printer to operate at a higher speed. Once the printer speed has adjusted to the new section length or foil removal rate the compensation roller moves about a point which is now at a different location with respect to the ramp of the proximity sensor. That is, with the changed point about which the compensation roller moves, the proximity sensor provides a mean signal on the basis of which the printer operates at an increased speed. The same—in reverse—occurs when the section lengths are decreased or the foil removal rate is reduced. In that case, the compensation roller moves about a point near the lower end (as shown in the figure) of the ramp of the proximity sensor.

Since with the changing points about which the compensating roller moves also the apexes of the oscillating movements of the compensating roller change, the position of the sensor also needs to be changed. The sensor must be displaced by such a distance that it continues to provide an output signal when the length of the foil portion between the cutting device and the printer corresponds to a multiple of the second predetermined length of an imprinted section which may be different from the previous section.

Further features and advantages of the invention will be described below with regard to a particular embodiment on the basis of the accompanying drawings.

BRIEF DESCRIPTION OF THE DRAWINGS

The sole FIGURE shows schematically an apparatus for imprinting a continuous foil according to the invention.

DESCRIPTION OF A PREFERRED EMBODIMENT

In a printing apparatus according to the invention, a foil 1 to be imprinted is unrolled from a roll 8 and guided through a printer 2. After the printer 2, the foil 1 is guided around a first return pulley 9*a* and then looped around a compensation roller 6 and an offset roller 5. The compensation roller 6 and the offset roller 5 define the opposite ends of a loop formed by the foil 1. After the offset roller 5, the foil is guided around a second return pulley 9*b*. After the second return pulley 9*b*, there is a foil section dispenser structure 10, which removes foil from the printing apparatus in a discontinuous manner. The dispenser structure is a common arrangement which repeatedly engages a portion of the foil and pulls it out of the printing apparatus by a pivot arm movement.

Ahead of the dispenser structure 10, there is a foil dividing or cutting device 4. The cutting device 4 may be designed to cut the foil or pierce the foil. In any case, the foil is marked by the cutting device 4 in accordance with the beginning of an imprinted section of the foil. The begin of the image imprinted by the printer is oriented on the basis of the beginning of the section.

The compensating roller 6 and the offset roller 5 are so arranged that they can be moved toward and away from each other. The offset roller 5 can be locked in position, while the compensation roller 6 is freely movably supported.

Adjacent the compensation roller 6, there is provided a proximity sensor structure 7, which has the shape of a ramp. The proximity sensor structure 7 is so arranged or shaped that the distance of the compensation roller 6 from the proximity sensor structure changes with the movement of the compensation roller. Outside the active range the distance of the compensation tion roller from the proximity sensor 7 structure is constant.

The compensation roller 6 is shown in the FIGURE to be movable in a vertical direction so that the foil loop extends vertically and the proximity sensor structure is disposed adjacent the vertical path of movement of the compensation roller 6. About at the level of the lower third of the active area of the proximity sensor sructure 7, a sensor 3 is movably supported. The sensor 3 is, a light barrier and has an output 3*a*. At the output 3*a* of the sensor 3 a signal is provided whenever the compensation roller 6 is in a particular position in front of the sensor 3. Suitably the position of the compensation roller, with imprinted images of medium length and with a medium dispensing rate, is about in the lower third of the active range of the proximity sensor 7. Such setting can be provided for by the offset roller 5. The output 3*a* of the sensor 3 is connected to an input 2*a* of the printer 2. When the length of the sections including the imprinted image changes, the position of the sensor needs to be adjusted so that it is adapted to the changed length of the foil between the cutting device 4 and the printer 2.

During the time in which the dispensing apparatus 10 is in a rest position for receiving a new section of the foil, no foil 1 is removed from the printing apparatus. With a continuous feeding of the foil 1 through the printer 2, the length of foil between the cutting device 4 and the printer 2 increases during that period. As a result, the compensation roller 6 moves downwardly until foil 1 is again removed from the printing apparatus by the dispensing apparatus 10. The representation in the FIGURE shows about the point in time when the dispensing apparatus 10 begins again to remove foil 1 from the printing apparatus.

During foil removal the foil is removed at a speed which is several times the speed with which the foil moves through the printer 2. Since now more foil is removed than is transported through the printer 2, the length of the foil 1 between the cutting device 4 and the printer 2 decreases and the compensating roller 6 accordingly move upwardly.

When the compensating roller 6 reaches a position in which the sensor 3 supplies, by way of the output 3*a*, a signal to the input 2*a* of the printer the length of the foil 1 between the cutting device and the point corresponding to the beginning of a section to be imprinted is for example 10 times the length of a section to be imprinted. Since the printer 2 receives a signal to print exactly at this point in time, the printed image is imprinted accurately at the beginning of a section. It is clear that, if dependent on the printer type, a certain distance must be taken into consideration, for example a distance corresponding to part of the circumference of a printing roller, which is in contact with the foil between the negative image on the printing roller and the imprint on the foil 1, adjustments must be made by a corresponding offset compensation.

The offset roller 5 is so arranged that the up and down movement of the compensation roller 6 which is caused by the continuous printing process and the non-continuous dispensing procedure, with a medium dispensing rate, occurs about at the center of the active area of the proximity sensor 7.

When the first predetermined length D of the printing image and consequently the second predetermined length L of the section to be imprinted is increased, the part of the foil 1, which is disposed between the cutting device 4 and the printer also becomes longer since the length of this part is always a predetermined multiple of. the length L for example 10 times the length of the second predetermined length L. The compensating roller 6 would then be left outside the range of the proximity sensor 7. The offset roller 5 is therefore moved upwardly such a distance that the back and forth movement of the compensating roller 6 is again centered at a point adjacent the active area of the proximity sensor.

Since the sensor 3 must provide a signal at its output 3*a*, whenever the length of the foil 1, which is between the cutting device 4 and the printer 2 is for example 10 times the second predetermined length L the sensor 3 is preferably movably supported. In this way, it can be adjusted to the different movement paths of the compensation roller 6.

Although the invention has been described in connection with a printing apparatus from which the foil 1 is removed in a stepwise fashion, the foil 1 could also be removed from the printing apparatus in a continuous fashion. Since with a continuous removal of the foil 1 from the printing apparatus, there may be no need for the compensating roller 6, the design of the printing apparatus would be different. It is however important in accordance with the invention that there is a sensor 3, which provides at its output signal when the length of the foil 1 between the cutting device 4 and the printer 2 is a multiple of the second predetermined length of the section of the foil 1 to be imprinted.

What is claimed is:

1. An apparatus for accurately imprinting, onto a continuous unmarked foil, print images of a predetermined first length D, wherein said foil is divided, after the imprinting, into sections of a predetermined second length L, on which said print images are accurately positioned, said apparatus comprising: a printer including an input for receiving a signal to initiate printing of said printer, a foil section delivery and cutting device disposed in spaced relationship from said printer and receiving said foil which has been imprinted by said printer for cutting said foil into said sections L, a foil guide structure for transferring said foil from said printer to said foil section delivery device along a predetermined foil path and including return pulleys and a compensating roller around which said foil extends to form a loop, said compensating roller bein:g movably supported so as to accommodate slack in said foil during periods in which said foil is resting in said delivery device while being cut into said sections, a sensor arranged adjacent said foil loop for detecting the position of said compensating roller which depends on the length of the foil between the delivery device and the printer, said sensor having an output connected to the input of said printer for supplying a printing signal to said printer when said compensating roller passes said sensor at which point the length of said foil between said delivery device and the point of the foil corresponding to the beginning of a section to be imprinted is a predetermined whole number multiple of the second length L of said sections to initiate printing of said printer accurately within a section of said foil.

2. An imprinting apparatus according to claim 1, wherein said printer is a continuously printing electrophotographic printer.

3. An imprinting apparatus according to claim 1, wherein an offset roller is disposed along the path of said foil such that said foil loop is formed between one of said return pulleys, said compensating roller and said offset roller, said offset roller being movably supported for controlling the length of said foil between said delivery device and said printer.

4. An imprinting apparatus according to claim 1, wherein means are provided for controlling the printer speed depending on the mean position of said compensation roller.

* * * * *